US009547271B2

(12) United States Patent
Taig et al.

(10) Patent No.: US 9,547,271 B2
(45) Date of Patent: Jan. 17, 2017

(54) PRINTING ASSEMBLY

(75) Inventors: Elad Taig, Ramat Gan (IL); Zohar Goldenstein, Nes Ziona (IL); Haggai Abbo, Kyriat Ono (IL); Gilad Tzori, Moshav Satariyya (IL); Martin Chauvin, Tel Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 3047 days.

(21) Appl. No.: 11/740,642

(22) Filed: Apr. 26, 2007

(65) Prior Publication Data

US 2008/0264283 A1 Oct. 30, 2008

(51) Int. Cl.

| | |
|---|---|
| ***B41F 9/08*** | (2006.01) |
| ***G03G 15/00*** | (2006.01) |
| ***B41F 5/00*** | (2006.01) |
| ***B41F 33/00*** | (2006.01) |
| ***B41F 13/10*** | (2006.01) |

(52) U.S. Cl.

CPC ..... *G03G 15/757* (2013.01); *B41F 5/00* (2013.01); *B41F 9/08* (2013.01); *B41F 13/10* (2013.01); *B41F 33/00* (2013.01)

(58) Field of Classification Search

CPC ..... B41F 5/00; B41F 9/08; B41F 13/10; B41F 33/00; G03G 15/757

USPC ..... 101/216, 375, 484

See application file for complete search history.

(56) References Cited

U.S. PATENT DOCUMENTS

| | | | | |
|---|---|---|---|---|
| 5,201,272 | A * | 4/1993 | Simon | 101/485 |
| 5,628,188 | A * | 5/1997 | Kordak | 60/449 |
| 6,408,748 | B1 * | 6/2002 | Hajek et al. | 101/177 |
| 6,641,245 | B1 * | 11/2003 | Kelly et al. | 347/19 |
| 6,817,291 | B2 * | 11/2004 | Kobayashi et al. | 101/216 |
| 6,823,792 | B2 * | 11/2004 | Grutzmacher et al. | 101/483 |
| 6,880,690 | B2 * | 4/2005 | Weis | 192/85.2 |
| 7,113,717 | B2 * | 9/2006 | Bott et al. | 399/67 |
| 7,533,610 | B2 * | 5/2009 | Dittenhofer | 101/480 |
| 7,779,757 | B2 * | 8/2010 | Schafer et al. | 101/218 |
| 2004/0025724 | A1 * | 2/2004 | Hajek et al. | 101/220 |

FOREIGN PATENT DOCUMENTS

| | | | |
|---|---|---|---|
| EP | 0786341 | * 12/1996 | B41F 33/00 |
| EP | 1594017 | 11/2005 | |
| JP | 04037542 | * 6/1990 | B41F 9/08 |

* cited by examiner

*Primary Examiner* — Matthew G Marini
*Assistant Examiner* — Marissa Ferguson Samreth
(74) *Attorney, Agent, or Firm* — HP Inc. Patent Department

(57) ABSTRACT

The present invention provides a printing assembly which includes a printing drum such as an impression drum, a pair of eccentric bearings between and on which the drum is mounted for rotation, a pair of self aligning bearings on which the eccentric bearings are supported, and a pair of frameless motors directly connected to the eccentric bearings in order to effect the rotation thereof through closed loop feedback control, in order to facilitate the automatic and accurate control of pressure level and uniformity along the nip of a printing press.

15 Claims, 5 Drawing Sheets

PRINTING ASSEMBLY

FIELD OF THE INVENTION

The present invention is concerned with a printing assembly, and in particular a printing assembly for use in a printing press and which enables closed loop control of the pressure along a nip defined between an intermediate transfer medium (ITM) drum and an impression (IMP) drum.

BACKGROUND OF THE INVENTION

The image transfer mechanism in many printing presses is based on hot and pressurized thermal transfer. Such printing presses generally incorporate an intermediate transfer medium (ITM) drum and an impression (IMP) drum between which is defined a nip though which paper or other printing medium is drawn, and onto which paper an image is transferred in known manner. In order to achieve optimal performance in terms of PQ, transferability and durability of the image, the pressure level and uniformity along the nip, and therefore from side to side of the ITM drum, must be strictly controlled. Currently, the dimensions of the nip rather than the pressure along the nip is monitored.

If a strain gauge is incorporated, then an open loop control is achieved on the pressure along the nip. However, such open loop control still requires manual adjustments and suffers from an inability to make the required corrections in high speed machines, especially in cases when the printing is to be carried out on several kinds of paper with different grammage. In such situations, several null cycles are required in the switching of the paper.

European patent application EP 1594017 discloses a fuser system of a xerographic device having a fuser drum and a pressure drum which in use bear against one another such as to form a nip, and which system utilises closed loop feedback to control the nip pressure.

The system of the present invention has been developed to overcome the above mentioned problems. In addition the present invention is adapted to eliminate or reduce printing artefacts e.g. banding which are formed when the blanket drum rolls into the region of the gripper's gap in the impression drum. At the start of the gap the force between the blanket drum and the impression drum goes abruptly to zero causing the printing unit to vibrate and also accelerate the blanket drum. When the drums come into contact again at the end of the gap the pressure abruptly builds up again. These fluctuations of the contact pressure and circumferential speed cause printing artefacts. The printing assembly of the present invention provides a high bandwidth along with utilization of advanced control options such as: feed-forward and gain scheduling in order to allow the printing assembly to adequately withstand the abrupt torque disturbance keeping the IMP drum position and speed.

SUMMARY OF THE INVENTION

There is provided a printing assembly comprising a drum; a pair of eccentric bearings between and on which said drum is mounted for rotation; a pair of drives to effect independent rotation of the eccentric bearings; and a closed loop control circuit actuating the drives in response to torque based feedback from the drives.

The assembly may optionally comprise a pair of self-aligning bearings, each eccentric bearing being mounted within one of said self-aligning bearings, said pair of drives effecting rotation of said eccentric bearings on said self-aligning bearings.

Optionally each drive is rigidly coupled to the respective eccentric bearing.

Optionally each drive is positioned concentrically with the respective self-aligning bearing.

Optionally, said torque based feedback is derived from the electric current drawn by the drives.

Optionally, each each drive comprises a frameless motor.

Optionally, each eccentric bearing comprises an outer casing and an inner bearing mounted eccentrically within said outer casing.

Optionally, each drive is rigidly coupled to said outer casing of the respective eccentric bearing.

Optionally, each eccentric bearing comprises an outer casing and an inner bearing mounted eccentrically within said outer casing, said outer casing of each eccentric bearing being mounted concentrically within the respective self-aligning bearing.

Optionally, each self-aligning bearing comprises a spherical roller bearing.

Optionally, each inner bearing comprises a cylindrical roller bearing.

Optionally, the assembly comprises a pair of encoders, each of said drives having one of said encoders in operative association therewith and operable to indicate the rotational position of said drive.

Optionally, each drive comprises a frameless motor having a rotor directly coupled to said outer casing of the respective eccentric bearing.

Optionally, the assembly comprises a housing on either side of said drum, each housing enclosing the respective eccentric bearing and self-aligning bearing; and in which assembly each drive comprises a frameless motor having a stator housing rigidly connected to the respective housing.

In another aspect there is provided a printing assembly comprising a drum; a pair of bearings on which said drum is mounted for rotation and which facilitate the radial displacement of a respective end of said drum; a pair of drives operable to effect the independent displacement of each end of said drum; wherein each drive is directly connected to the respective bearing.

In a further aspect there is provided a printing assembly comprising a first drum and a second drum between which is defined a nip; a pair of eccentric bearings between and on which said first drum is mounted for rotation; a pair of self-aligning bearings, each eccentric bearing being mounted within one of said self-aligning bearings; a pair of drives to effect independent rotation of the eccentric bearings on the self-aligning bearings in order to substantially equalize the pressure along the nip by controlling the gap between the first and second drums; and a closed loop control circuit actuating the drives in response to torque based feedback from the drives.

As used herein, the term "directly" is intended to mean that a connection between two components does not involve intermediate couplings or linkages or the like, which would introduce a flexibility between the two components, and which when concerned with the transfer of torque from one to the other component, would thus result in a lag in the rotational displacement between the two components, or in other words a lack in synchronisation between the two components when undergoing rotation displacement.

DETAILED DESCRIPTION OF THE DRAWINGS

Figure 1:
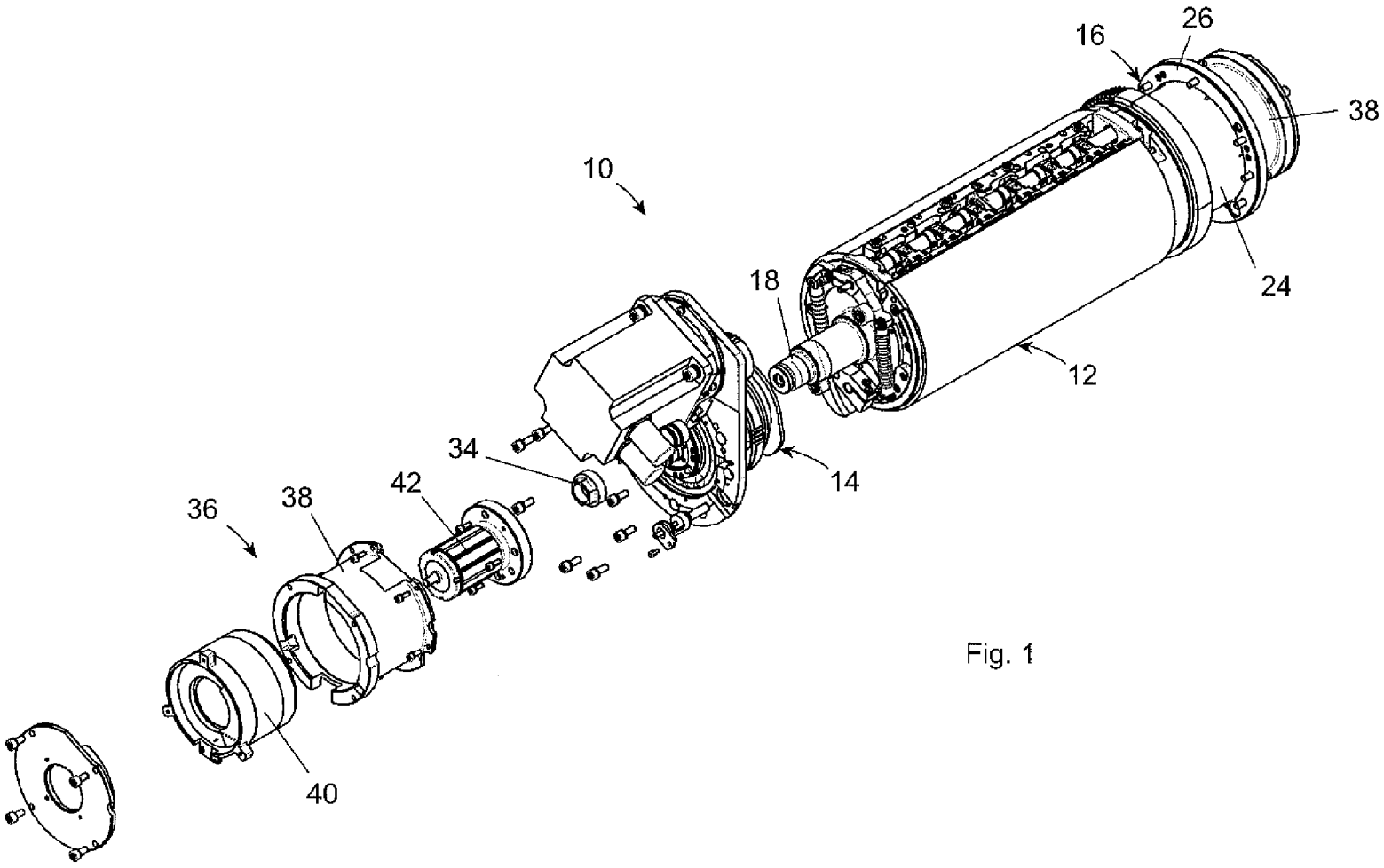
FIG. 1 illustrates a perspective view of an embodiment of a printing assembly, according to the present invention, in which one side of the assembly is shown exploded.
Figure 2:
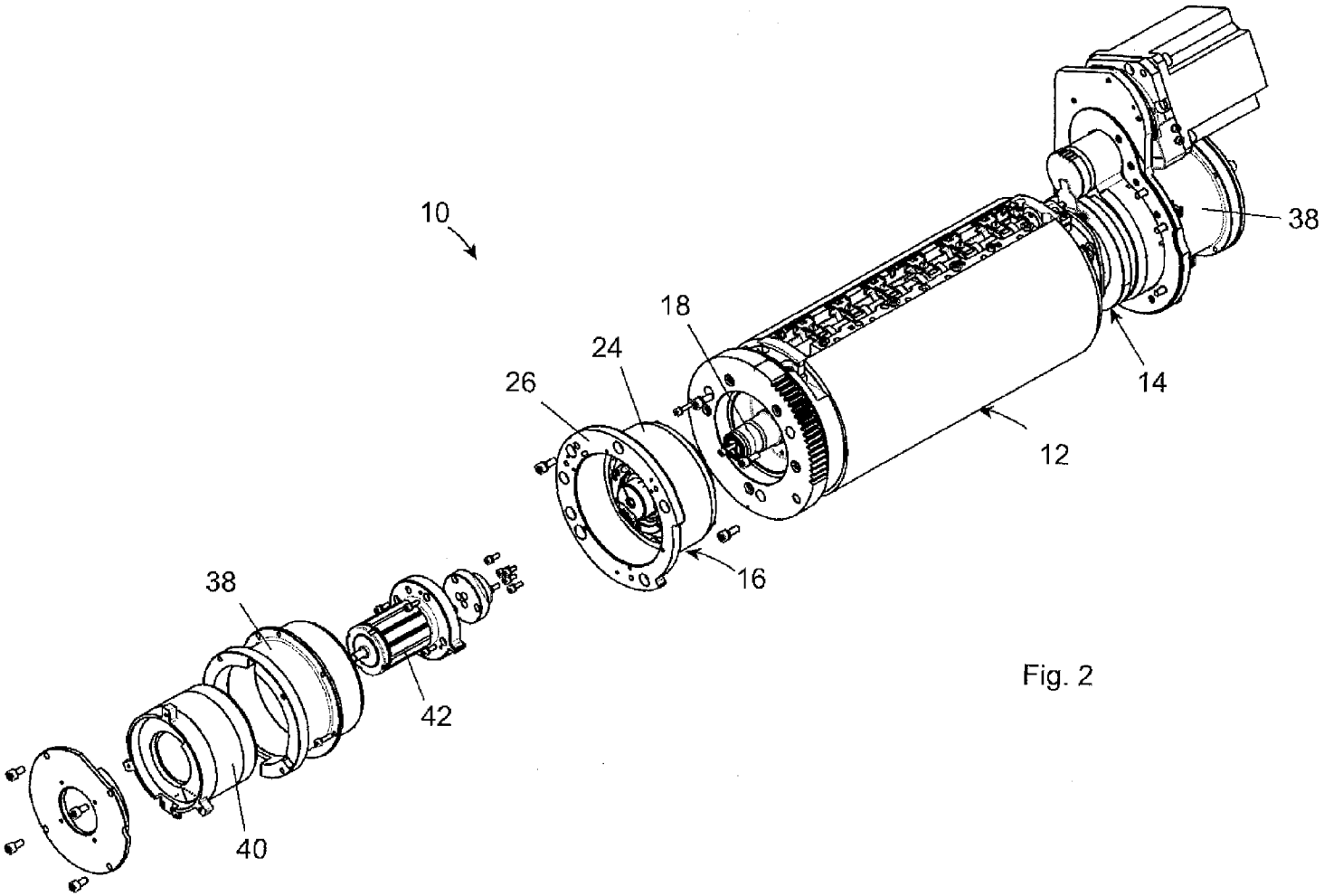
FIG. 2 illustrates an alternative perspective view of the printing assembly illustrated in FIG. 1, in which an opposed side of the assembly is shown exploded.

Referring now to the accompanying drawings, there is illustrated a printing assembly, generally indicated as 10, which comprises a drum 12 which in the embodiment illustrated is an impression (IMP) drum, but which could of course be any other drum, and which is intended to form part of a larger printing press (not shown). In particular, the assembly 10 is intended to be located adjacent an intermediate transfer medium (ITM) drum (not shown) such as to define a nip between the drums, as is well known in the art. In use, an image receiving material, such as for example a sheet of paper (not shown) having a toner image applied, is passed through the nip. As it passes through the nip, pressure and heat are applied to the toner image on the paper, which is thus fixed to the paper or other printing material.

As will be described in detail hereinafter, the printing assembly 10 of the invention is adapted to automatically adjust the position of the drum 12 relative to the ITM drum (not shown) or other surface, in order to vary the pressure along the nip. The printing assembly 10 can thus maintain the pressure within desired operating specifications. This will, for example, allow the assembly 10 to automatically adjust the pressure along the nip to suit different weight papers, or to effect corrections to the pressure in order to compensate for any number of internal or external factors affecting the pressure or uniformity thereof. The assembly 10 is adapted to measure and monitor the pressure along the nip and to use that information to provide feedback for the automatic adjustment of the pressure along the nip. Thus, as will be described, the assembly 10 provides closed-loop feedback control of the pressure level and uniformity along the nip.

The assembly 10 comprises a first bearing assembly 14 on one side of the drum 12, and a second bearing assembly 16 on an opposed side of the drum 12. The drum 12 is mounted for rotation between the bearing assemblies 14, 16 via a shaft 18 of the drum 12.

Figure 3:
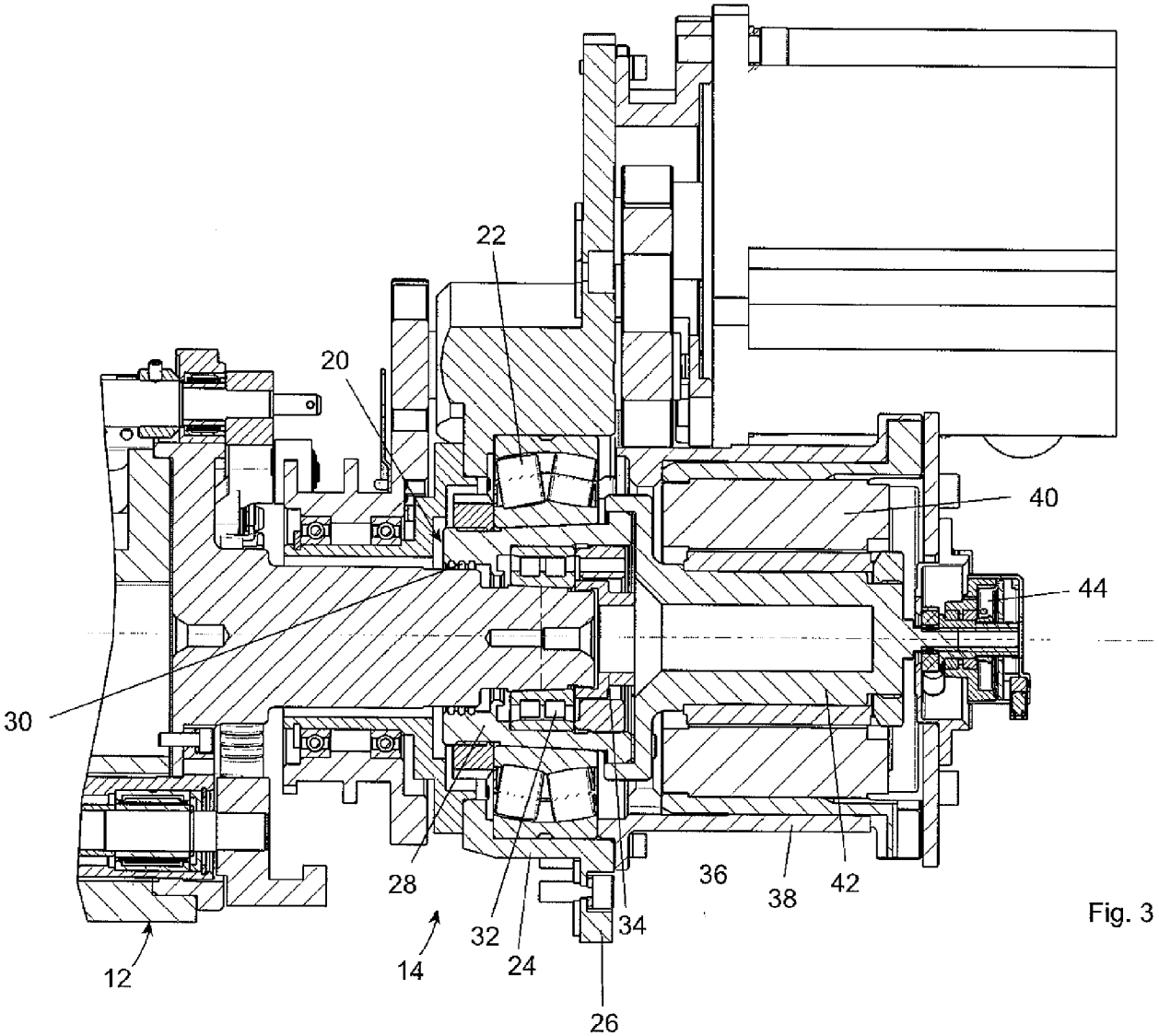
FIG. 3 illustrates an assembled sectioned view of the exploded side of the assembly illustrated in FIG. 1.
Figure 4:
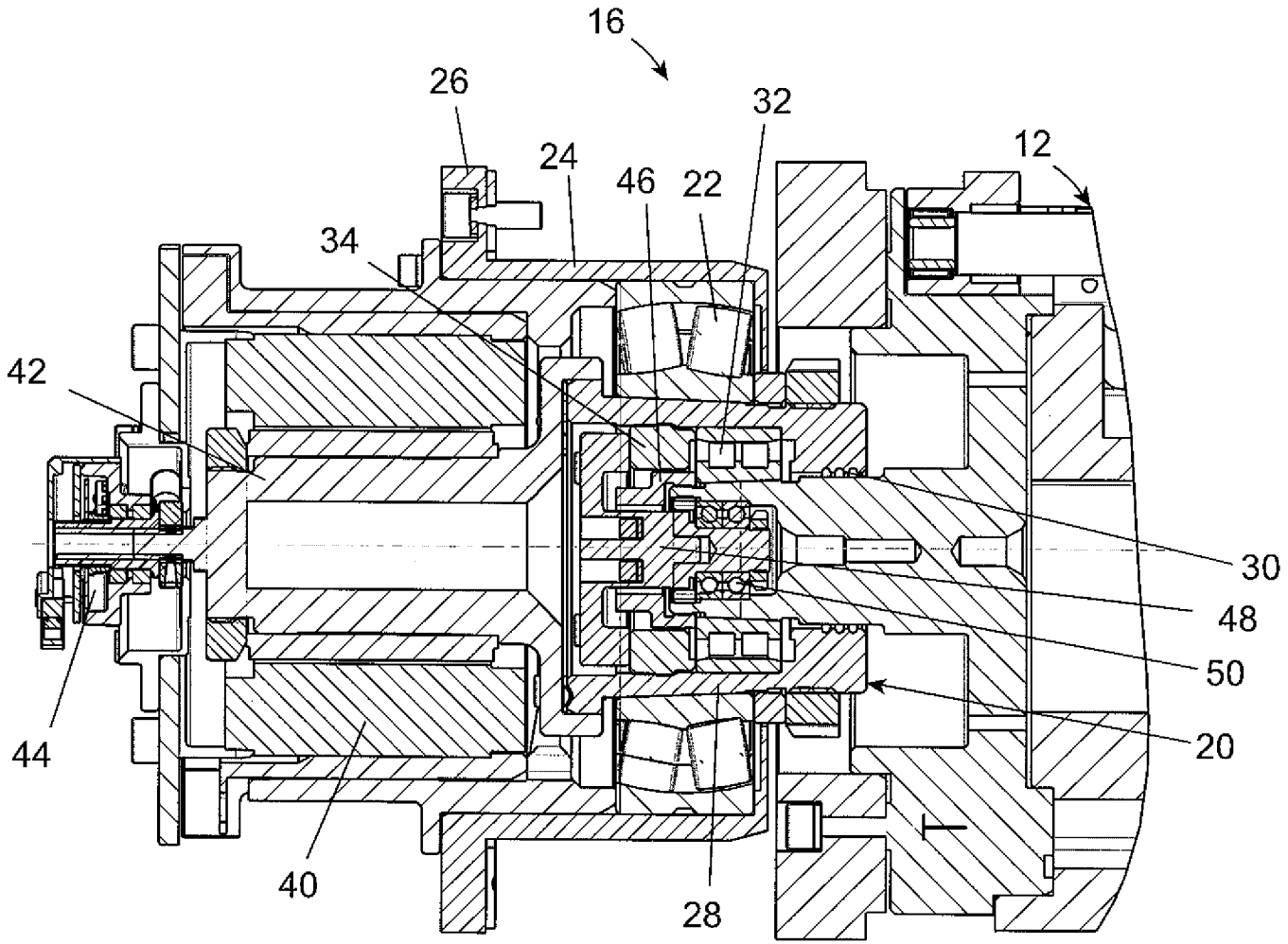
FIG. 4 illustrates an assembled sectional view of the exploded side of the assembly illustrated in FIG 2.
Figure 5:
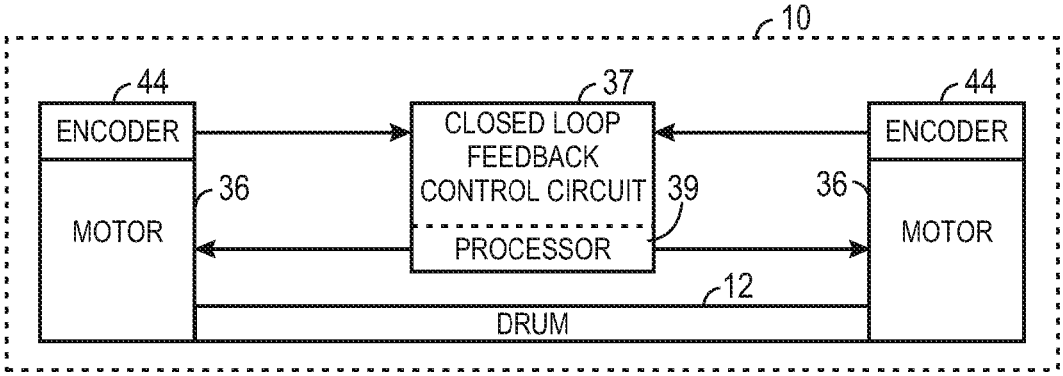
FIG. 5 illustrates a block diagram of the assembly illustrated in FIG. 1.

Referring now in particular to FIGS. 3 and 4, and as mentioned above the printing assembly 10 is adapted to automatically effective the displacement of the drum 12 towards and away from, in use, an ITM drum or the like, in order to accurately control the pressure along the nip. The bearing assemblies 14, 16, in terms of implementing this functionality, are substantially identical in configuration and operation.

Referring first to FIG. 3, the first bearing assembly 14 is illustrated in section. The bearing assembly 14 comprises an eccentric bearing 20 on which the shaft 18 is supported for rotation. The eccentric bearing 20 is itself mounted for rotation within a self-aligning bearing 22, which is optionally a spherical roller bearing (SRB) but may of course be any other suitable functional alternative. The self-aligning bearing 22, and therefore the eccentric bearing 20, are mounted rigidly within a cylindrical housing 24 which in use is suitably and rigidly secured in position within a printing press (not shown), in the embodiment illustrated by means of an annular flange 26.

The eccentric bearing 20 comprises a cylindrical outer casing 28, which is concentrically mounted within the self-aligning bearing 22, the casing 28 having an eccentrically positioned aperture 30 in the front thereof, and an inner bearing 32 on which the shaft 18 is supported. In the embodiment illustrated the inner-bearing 32 comprises a cylindrical roller bearing (CRB) although any other suitable alternatively may be employed. However, as will become apparent from the following description, the use of a cylindrical roller bearing provides significant stiffness in supporting the drum 12.

The inner bearing 32 is rigidly secured in position within the outer-casing 28 by means of a lock-ring 34, which is pressed up against the inner-bearing 32. As the inner-bearing 32 is positioned eccentrically of the outer-casing 28, the shaft 18 and therefore the drum 12 is supported eccentrically of the outer-casing 28. It will thus be appreciated that if the outer-casing 28 is rotated on the self-aligning bearing 22, the drum 12 will be displaced, in an accurate path, towards and away from the ITM drum, or other words in an essentially radial direction with respect to the drum 12. This motion is known as the engage/disengage motion, in that the drum 12 may be engaged or disengaged with the ITM drum (not shown) and/or the force of engagement with the ITM drum can be varied. Thus, and as is described in more detail hereinafter, by displacing each side of the drum 12 using the first and second bearing assemblies 14, 16, the pressure applied along the nip can be controlled.

In order to effect the rotational displacement of each eccentric bearing 20, the printing assembly 10 comprise a pair of drives, in the form of frameless motors 36, one on either side of the drum 12. Each motor 36 comprises a stator housing 38 within which is rigidly mounted a stator 40 and a rotor 42 located concentrically therein. In the embodiment illustrated, and for reasons set out hereinafter, the stator housing 38 of each frameless motor 36 is rigidly connected to the housing 24, while the rotor 42 directly and therefore rigidly connected to the outer casing 28 of the respective eccentric bearing 20. In the embodiment illustrated, the rotor 42 is bolted to the respective outer casing 28, although it will of course be appreciated that any other suitable means of securing the rotor 42 to the eccentric bearing 20 may be employed. Again however any such connection must be sufficiently rigid, as set out hereinafter. The frameless motors 36 are significantly stiffer than an equivalent conventional electric motor (not shown), thus adding to the overall stiffness and rigidity of the printing assembly 10.

It will thus be appreciated that rotation of the rotor 42 within the stator 40, by the application of an electric current to each motor 36 in a known manner, will effect rotation of the outer casing 28 of the eccentric bearing 20. This rotation of the outer casing 28 will thus effect the engage/disengage motion of the drum 12. The direction and magnitude of rotation of the outer casing 28 of each eccentric bearing 20 will determine the displacement of the drum 12 towards or away from the ITM drum, and will thus dictate the change in pressure experienced along the nip during use. In order that the exact rotational position of each eccentric bearing 20, and therefore the respective frameless motor 36 can be determined, the assembly 10 is provided with an encoder 44 mounted concentrically on each motor 36. Each encoder 44, in known fashion, can generate a signal indicative of the rotational position of the respective frameless motor 36.

Referring now to FIG. 4, the second bearing assembly 16 is illustrated. As with the first bearing assembly 14, the second bearing assembly 16 also comprises an eccentric bearing 20 on which the shaft 18 of the drum 12 is supported. The second bearing assembly 16 further comprises a self-aligning bearing 22 within which the eccentric bearing 20 is mounted for rotation. Both are rigidly mounted within a cylindrical housing 24 which in use is rigidly fixed in position via a flange 26. A stator housing 38 of the frameless motor 36 is bolted to the housing 24, while a rotor 42 of the motor 36 is directly and rigidly fixed to the outer casing 28 of the eccentric bearing 20.

The shaft 18 of the drum 12 passes through an eccentrically positioned opening 30 in the outer casing 28, and is then supported on an eccentrically mounted inner bearing 32, which in the embodiment illustrated is in the form of a cylindrical roller bearing (CRB). The inner bearing 32 is secured in position within the casing 28 by means of a lock-ring 34. The free end of the shaft 18 projects beyond the inner bearing 32 and a lock nut 46 is secured thereon. To axially secure the shaft 18, a bolt 48 is passes through the cylindrical lock nut 46 and is secured on a pair of bearing 50 which, in the embodiment illustrated, are provided as an angular contact ball-bearings. By tightening the bolt 48, pressure is brought to bear against the lock-ring 34, in order to rigidly clamp the inner bearing 32 in position within the outer casing 28. Although the bolt 48 is locked in abutting engagement with the lock-ring 34, the bearings 50 and the inner bearing 32 ensure that the shaft 18 is free to rotate within the second bearing assembly 16.

As with the first bearing assembly 14, the frameless motor 36 connected to the second bearing assembly 16 is operable to effect the engage/disengage motion of the drum 12 by effecting rotation of the outer casing 28 on the self-aligning bearing 22.

In order to control and co-ordinate the operation of the pair of frameless motors 36, the printing assembly 10 comprises a closed loop feedback control circuit 37, which utilises various signals associated with the assembly 10, in particular from the pair of encoders 44 and the electric current driving the motors 36, in order to effect operation and control of the position of the drum 12. The main component of the control circuit 37 is a processor 39 operable to determine, based on signals inputted thereto, whether or not the nip pressure and/or uniformity is within operational specifications. If the pressure and/or uniformity is outside the operational specification, the processor 39 is adapted to effect actuation of the motors 36 in order to make the necessary corrections to the position of the drum 12, and thus the pressure along the nip. As the motors 36 change the pressure along the nip, feedback is provided to the processor 39 in order to facilitate closed loop feedback control.

In order to allow the pressure along the nip to be measured, the electric current drawn by each of the frameless motors 36, while effecting displacement of the drum 12, is measured. By measuring this current, the torque of the motor can be measured, which is related to the pressure applied along the nip. The pressure at the nip is dictated by the force applied by the drum 12, and this force is proportional to the torque of the motors 36. In particular the torque is dependent on the distance between the axis of the motor 36 and the point of contact between the drum 12 and the ITM drum (not shown). This dimension will vary slightly as the drum 12 is displaced along an arcuate path by rotation of the eccentric bearings 20, although by measuring the angular position of each side of the drum 12 using the encoders 44, this distance can be instantaneously calculated by the processor 39. Thus, by measuring the electrical current drawn by each of the motors 36, the torque of the motor 36 can be calculated, and thus using the distance calculated by the processor 39, the force and therefore pressure along the nip can be determined. If the pressure along the nip is outside the operational specifications, the processor 39 can suitably alter the electric current supplying one or both motors 36 until the drum 12 is positioned to give the correct pressure along the nip.

Thus, the printing assembly 10 is capable of continually monitoring and adjusting the pressure along the nip to ensure that it remains within operational specifications. The operational specifications may change if, for example, paper of a different thickness or grammage is being processed by the printing assembly 10. In such a situation, the assembly 10 will automatically adjust the pressure along the nip to suit the grammage of the paper, and is capable of implementing this correction or adjustment without requiring a null cycle. This is particularly advantageous in high speed printing presses. For this purpose the processor 39 of the feedback control circuit 37 optionally has access to a look up table containing nip pressure values or ranges for particular paper grammage values or ranges.

In order to enable highly accurate closed loop feedback control, the printing assembly 10, and in particular the mounting of the drum 12, and the elements achieving the engage/disengage motion, must be extremely rigid or inflexible. Any flexibility in the assembly 10 would significantly deteriorate the sensitivity of the feedback control. It is for this reason that the motors 36 are provided as high rigidity frameless motors, and that each rotor 42 is directly and rigidly connected to the eccentric bearing 20 on either side of the drum 12. The use of the cylindrical roller bearings for each of the inner bearings 32 ensures this rigidity is achieved at the interface between the shaft 18 and the bearing assemblies 14, 16.

Furthermore, the spherical roller bearing used for each self-aligning bearing 22 maintains the rigidity between the eccentric bearing 20 and the housing 24. This overall rigidity enables closing of the control loop with the required bandwidth to enable accurate control of the nip pressure, even in high speed printing presses.

While both the first and second bearing assemblies 14, 16 may be utilised simultaneously to effect identical displacements of either end of the drum 12 in order to control the nip pressure, it will be appreciated that independent adjustment of either side of the drum 12 is possible, and is often required in order to accurately control the nip pressure. It will thus be appreciated that the direction of the longitudinal axis of the drum 12 will undergo minute changes in response to displacements of differing magnitude at either end of the drum 12. In the absence of the pair of self-aligning bearings 22, such adjustments would not be possible, as the longitudinal axis of the drum 12 would be fixed in one direction. However, the pair of self-aligning bearings 22 allow these minute independent adjustments to be effected, while maintaining the overall stiffness or rigidity of the printing assembly 10. The self-aligning bearings 22 will track the shifting axis of the drum 12 in order to ensure that the displacement of the axis does not result in any resistance which would affect the sensitivity of the feedback control of the motors 36. The drum 12 is thus effectively "floating" between the pair of self-aligning bearings 22. While allowing this displacement of the axis of the drum 12, the self-aligning beatings 22, by virtue of being spherical roller bearings, maintain the rigidity of the system 10. Again, it is this rigidity that enables closed loop feedback control with the required bandwidth.

The invention is not limited to the embodiment described herein but can be amended or modified without departing from the scope of the present invention.

The invention claimed is:

1. A printing assembly comprising:

a drum;

a pair of eccentric bearings between and on which the drum is mounted for rotation; and a pair of drives to effect independent rotation of the pair of eccentric bearings to adjust a pressure applied by the drum, wherein the printing assembly is configured to effect actuation of the pair of drives in response to torque based feedback derived from an electric current drawn by each of the pair of drives.

2. A printing assembly according to claim 1 comprising a pair of self-aligning bearings, each eccentric bearing being mounted within one of the pair of self-aligning bearings, the pair of drives effecting rotation of the eccentric bearings on the pair of self-aligning bearings.

3. A printing assembly according to claim 2 in which each eccentric bearing comprises an outer casing and an inner bearing mounted eccentrically within the outer casing, the outer casing of each eccentric bearing being mounted concentrically within the respective self-aligning bearing.

4. A printing assembly according to claim 2 in which each self-aligning bearing comprises a spherical roller bearing.

5. A printing assembly according to claim 1 in which each drive is rigidly coupled to the respective eccentric bearing.

6. A printing assembly according to claim 5 in which each drive is positioned concentrically with the respective self-aligning bearing.

7. A printing assembly according to claim 2 comprising a housing on either side of the drum, each housing enclosing the respective eccentric bearing and self-aligning bearing wherein each drive comprises a frameless motor having a stator housing rigidly connected to the respective housing.

8. A printing assembly according to claim 1 in which each drive comprises a frameless motor.

9. A printing assembly according to claim 1 in which each eccentric bearing comprises an outer casing and an inner bearing mounted eccentrically within the outer casing.

10. A printing assembly according to claim 9 in which each drive is rigidly coupled to the outer casing of the respective eccentric bearing.

11. A printing assembly according to claim 9 in which the inner bearing comprises a cylindrical roller bearing.

12. A printing assembly according to claim 9 in which each drive comprises a frameless motor having a rotor directly coupled to the outer casing of the respective eccentric bearing.

13. A printing assembly according to claim 1 comprising a pair of encoders, each of the drives having one of the pair of encoders in operative association therewith and operable to indicate the rotational position of the drive.

14. A printing assembly comprising:

a drum;

a pair of bearings on which the drum is mounted for rotation and each of which independently facilitate the radial displacement of a respective end of the drum; and a pair of drives operable to effect the radial displacement of each end of the drum, wherein the printing assembly is configured to effect actuation of the drives in response to torque based feedback derived from an electric current drawn by each of the pair of drives, and wherein each drive is directly connected to the respective bearing.

15. A printing assembly comprising:

a first drum and a second drum between which is defined a nip;

a pair of eccentric bearings between and on which the first drum is mounted for rotation;

a pair of self-aligning bearings, each eccentric bearing being mounted within one of the self-aligning bearings; and a pair of drives to effect independent rotation of the eccentric bearings on the self-aligning bearings in order to vary the pressure along the nip, wherein the printing assembly is configured to effect actuation of the drives in response to torque based feedback derived from an electric current drawn by each of the pair of drives.

* * * * *